United States Patent [19]

Bengali et al.

[11] 4,222,779

[45] Sep. 16, 1980

[54] NON-CHROMATE CONVERSION COATINGS

[75] Inventors: Ajay M. Bengali, Hackensack; Richard F. Zuendt, Oradell; John L. H. Allan, Glen Rock; Philip D. Readio, Sparta, all of N.J.

[73] Assignee: Dart Industries Inc., Los Angeles, Calif.

[21] Appl. No.: 45,160

[22] Filed: Jun. 4, 1979

Related U.S. Application Data

[63] Continuation-in-part of Ser. No. 955,812, Oct. 30, 1978, abandoned.

[51] Int. Cl.[2] ..... C09D 5/08; C23F 7/00

[52] U.S. Cl. ..... 106/14.12; 106/14.15; 106/14.21; 106/14.45; 148/6.17; 148/6.24; 148/6.27; 148/31.5; 252/79.4; 252/387; 252/389 A; 252/391; 252/392; 428/470

[58] Field of Search ..... 106/14.12, 14.15, 14.45, 106/14.21; 148/6.17, 6.24, 6.27, 31.5; 156/665, 666; 422/15, 16; 428/470; 252/79.4, 387, 389 A, 391, 392

[56] References Cited

U.S. PATENT DOCUMENTS

| | | | |
|---|---|---|---|
| 3,663,441 | 5/1972 | Gulla | 252/79.4 |
| 3,668,131 | 6/1972 | Banush et al. | 252/79.4 |
| 4,158,592 | 6/1979 | Readio et al. | 252/79.4 |

*Primary Examiner*—Lorenzo B. Hayes

*Attorney, Agent, or Firm*—Bryant W. Brennan; Harold R. Beck

[57] ABSTRACT

Improved brightness and corrosion resistance are imparted to metal surfaces such as zinc plated surfaces, by treatment with a non-toxic solution comprised of sulfuric acid, hydrogen peroxide and a silicate. Certain organophosphorus and organonitrogen compound additives further enhance the corrosion resistance.

38 Claims, No Drawings

NON-CHROMATE CONVERSION COATINGS

This application is a continuation-in-part of pending application Ser. No. 955,812, filed Oct. 30, 1978 now abandoned.

BACKGROUND OF THE INVENTION

The formation of chromate conversion coatings on surfaces of various metals, such as zinc and cadmium, is presently the most common technique of imparting increased brightness and corrosion resistance to the metal. In a typical process, the metal work pieces are immersed in an acidic solution containing hexavalent chromium compounds, which react with the metal causing the precipitation of a complex gel-like coating or film of trivalent chromium and entrapped soluble hexavalent chromium compounds onto the metal surface. The coated work pieces are then rinsed and dried under controlled conditions.

There are several serious disadvantages common to all chromate conversion coating processes. One of these is the relatively short life of the process bath expressed in terms of unit surface area coated per unit volume of bath. The main reason for the short life is the continuous build-up in the bath of dissolved trivalent chromium resulting from the oxidation-reduction reactions that occur between the metal and the hexavalent chromium. Trivalent chromium is a contaminant in the process affecting the coating efficiency. Thus, when reduced coating activity is noted, or when the contaminants have built up to a certain predetermined level, a process solution of this type is at least partially replaced with freshly prepared solution, and ultimately completely discarded in favor of a fresh bath.

The disposal of the spent process solution is wasteful, as the solution still contains considerable quantities of hexavalent chromium. Not only does the loss of these values contribute significantly to the overall cost of the coating process, but disposal also adds to this cost in that the solutions present a substantial waste treatment problem. Hexavalent chromium is highly toxic and must be reduced to the trivlent form, e.g. by reaction with sodium hydrosulfite or sodium bisulfite, and is thereafter precipitated from solution by addition of alkalies, such as sodium carbonate or lime. After dewatering of the precipitate by settling or filtration, the concentrated sludge of trivalent chromium hydroxide must be disposed of in specially designated areas, since trivalent chromium is still too toxic to be used as landfill. Substantial waste treatment requirements of spent rinse waters are also created due to dragout of toxic chemicals from the process bath into subsequent rinse waters. Although there are integrated processes for the reoxidation and regeneration of spent chromate solutions and rinse water, the small processor usually finds that the refined and sophisticated techniques involved are neither practical nor economically feasible for solving his waste treatment problems.

It is, therefore, an object of the present invention to provide a novel conversion coating and a method of its forming, which coating is as bright and corrosion resistant as conventional chromate conversion coatings.

Another object is to provide a novel conversion coating solution, which has a longer service life.

A further object is to provide a novel conversion coating solution, which, after use, requires minimal after-treatment and can be disposed of as municipal landfill.

These and other objects will become apparent from the following specification, examples, and claims.

THE INVENTION

In accordance with the present invention there is provided a novel conversion coating solution which comprises an aqueous solution of from about 0.2 g/l to about 45 g/l of free $H_2SO_4$, from about 1.5 g/l to about 58 g/l of $H_2O_2$ and from about 3 g/l to about 33 g/l of $SiO_2$. The last component is conveniently provided in the form of a soluble silicate, e.g. sodium silicate or potassium silicate, of predetermined contents of $SiO_2$ and $Na_2O$ or $K_2O$. Ammonium or lithium are also useful in providing the $SiO_2$ component.

Although the acidic silicate "solution" may or may not be a true solution but rather in the form of a hydrosol, for the purpose of this application, the term "solution" is intended to cover a hydrosol as well as a true solution.

The mole ratios of $SiO_2$ to either $Na_2O$ or $K_2O$ generally range between 1 and 4, and it is preferred to use those silicates wherein the mole ratio is at least about 1.8 and most preferably at least about 2.2. The solution is easily prepared, e.g. by first adding sufficient sulfuric acid to the water under agitation to provide the desired free $H_2SO_4$ content and taking into account that some of the free acid will be subsequently neutralized by the $Na_2O$ or $K_2O$ portions introduced with the silicate. The silicate is added under agitation to the cooled acidic solution until it is completely dispersed. The peroxide addition is made last, preferably just prior to use. The sequence of addition can be changed, however, without any detrimental effect, provided that the silicate is acidified with sulfuric acid prior to mixing with the hydrogen peroxide, or peroxide decomposition will occur.

The preferred concentrations of the components in the aqueous solution are from about 1.8 g/l to about 18 g/l of free $H_2SO_4$, from about 7 g/l to about 29 g/l of $H_2O_2$ and from about 8 g/l to about 18 g/l of $SiO_2$.

The solution is useful for forming conversion coatings on various metallic surfaces, such as those of zinc, cadmium, silver, copper, aluminum, magnesium, and zinc alloys.

The most common application is, however, in the formation of conversion coatings on zinc plated articles such as zinc plated steel articles, and the invention will be discussed hereinafter with respect to such application. The zinc plate provides the steel with cathodic protection against corrosion, and the conversion coating further improves the corrosion resistance, reduces the susceptibility to finger markings and enhances the appearance by chemical polishing of the article. It is important that the zinc plate deposit is relatively smooth and fine-grained prior to coating, and that the thickness of the plate deposit is at least 0.005 mm since some metal removal occurs when the film is formed. The preferred plate thickness is between about 0.005 mm and about 0.02 mm.

Usually the formation of the conversion coating follows immediately after the last rinse in the plating cycle. Thus, the freshly plated articles are immersed for a period of from about 5 seconds to about 300 seconds into the solution which is maintained at ambient temperatures. For best results, the immersion treatment is carried out for a duration of from about 20 seconds to about 50 seconds in a bath maintained at temperatures not less than about 20° C. and not more than about 35° C. The coated articles are subsequently rinsed, first in cold water and then briefly in warm water to aid drying of the films. The hot water rinse typically has a temperature in the range of from about 60° to about 70° C. The final step of the coating process is a drying step, which is carried out by any means that will neither abrade the soft and then rather fragile film, nor expose it to excessive temperatures, i.e. temperatures higher than about 70° C. The use of circulating warm air or an airblast are examples of suitable means in the drying operation. After drying, the conversion coatings are quite resistant to damage from abrasion and generally do not require the 12–24 hour aging necessary with conventional chromate conversion coatings.

The resulting conversion coatings have very good resistance to corrosion as determined by the accepted accelerated corrosion test ASTM B-117-64. By the use of one or more of certain organic promoters, either as additives to the solution of sulfuric acid-hydrogen peroxide-silicate or employed in a subsequent treatment, the corrosion resistance of the coatings can be further enhanced. The group I organophosphorus compounds and the group II organic nitrogen compounds specified hereinafter have been found to be especially useful in this respect.

The group I promoters are organic phosphorus compounds having the general formula:

$$[X(R_1)_m]_n.[R_2]_p.[X(R_1)_m]_q,$$

wherein X is a group of the formula

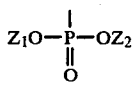

in which $Z_1$ and $Z_2$ independent from each other is hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

(c)

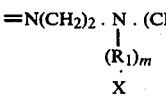

m=1 and (d) a $C_1$–$C_4$ alkylene or a $C_1$–$C_4$ hydroxy-substituted alkylene, m=0 or 1.

Examples of these organophosphorus compounds include $C_1$–$C_4$ alkyl phosphonic acids, $C_1$–$C_4$ hydroxyalkalenephosphonic acids, amino tri-$C_1$–$C_4$ alkylene phosphonic acids, $C_2$–$C_8$ alkylene diamine-tetra ($C_1$–$C_4$ alkylene phosphonic acid), diethylenetriamine-penta ($C_1$–$C_4$ alkylene phosphonic acid) as well as the acid or neutral sodium or potassium salts of any of the above-listed phosphonic acids. 1-hydroxyethylidene-1,1-diphosphonic acid is a preferred compound.

The organophosphorus compound or mixture of such compounds is added either to the conversion coating solution or to a subsequent aqueous bath to provide a concentration therein of from about 0.15 g/l to about 10 g/l, preferably from about 0.5 g/l to about 2 g/l.

The group II promoters are organonitrogen additives selected from thioacetamide, urea, thiourea, N-N'-alkyl substituted ureas or thioureas and cyclic N-N'-alkylene substituted ureas and thioureas, wherein said alkyl and alkylene groups each contain from 1 to 4 carbon atoms.

Particular examples of suitable promoters belonging to group II include tetramethyl urea, tetramethyl thiourea, dimethylthiourea, di-n-butyl thiourea, di-t-butyl thiourea, ethylene thiourea, etc. Thiourea is one preferred group II compound.

The organonitrogen compound or mixture of such compounds is either added to the conversion coating solution or to a separate aqueous solution to provide a concentration in either case of from about 0.5 g/l to about 50 g/l, preferably from about 1 g/l to about 10 g/l.

Mixtures of promoters from groups I and II can be used with advantage in the invention, e.g. a mixture of thiourea and 1-hydroxy-ethylidene-1,1diphosphonic acid.

Good results can also be obtained with group II promoters by employing a two-step technique, in which the articles to be coated are first dipped into the solution of $H_2SO_4$-$H_2O_2$-$SiO_2$ under the conditions described hereinbefore and then into a second solution of the group II additive in water, which solution is maintained in the same range of temperature, i.e. from about 20° to about 30° C. The immersion time in the second step should be from about 5 to about 300 seconds preferably from about 15 to about 50 seconds. If a group I promoter is used in combination with a group II promoter, it can be added to either of the solutions.

During the course of the coating process, the coating solution becomes depleted in both free sulfuric acid and hydrogen peroxide values and must be replenished. Therefore, monitoring of these values should be carried out on a regular basis to assure that the respective concentrations have not fallen below their minima and to assess the amounts needed for replenishment. Free sulfuric acid can be determined by conventional titration methods using sodium hydroxide or by pH determinations. In order to maintain the free sulfuric acid within the broad ranges of about 0.2 to about 45 g/l the pH should be controlled between about 0.5 and about 3.5 and preferably between about 1.0 and about 3.0 which approximately corresponds to a free sulfuric acid concentration of from about 1.8 to about 18 g/l. The hydrogen peroxide concentration levels are advantageously monitored by conventional titration with ceric ammonium sulfate. The silicate ($SiO_2$) consumption is relatively small compared to the consumptions of either the free sulfuric acid or the hydrogen peroxide, and generally neither monitoring (which can be carried out using e.g. colorimetric principles involving the reaction of silicate with ammonium molybdate to form a yellow-colored molybdo silicate solution) nor replenishment is required during the practical life of the conversion coating bath. The rate of consumption (i.e. percent decrease in concentration per unit time) of either of the group I and group II additives has been found to be approximately of the same order as that of the hydrogen peroxide consumption. Therefore, replenishments of the solutions with these additives are suitably carried out at the time of hydrogen peroxide replenishment in amounts proportional to the hydrogen peroxide addition.

In addition to the formation of conversion coatings of excellent properties, there are many other important advantages of the present invention. One of these is the extremely long life of the conversion solution before it is discarded in favor of a fresh solution. It has been found that the solutions are capable of treating up to approximately 185 $m^2$ of surface area per liter, which is far superior to the typical value of approximately 20 $m^2/l$ obtained with conventional chromate conversion coating baths.

Another and related advantage is that, apart from some build-up of dissolved metal in the solution, there are no detrimental by-products forming and accumulating therein during use, as is the case with conventional chromate conversion coating solutions, in which trivalent chromium rapidly builds up.

The most important advantage, however, is the nontoxic nature of the system, which greatly facilitates waste disposal of spent solutions from the conversion coating process. Rinse waters can usually be disposed of without any treatment required. Spent conversion coating baths are merely treated with lime for neutralization and removal of dissolved metal ions and phosphorus (when organophosphorus promoters are used) as a precipitate. After settling or other separation, the liquid phase may be disposed of safely in common sewers, while the dewatered sludge mainly composed of silicate can be dumped in municipal landfill areas.

The following examples are provided to illustrate and not to limit this invention.

EXAMPLE 1

The general procedures used in preparing the conversion coating solutions and test specimens, forming the conversion coatings and testing the corrosion resistance of the coatings are described below.

The aqueous conversion coating solution was prepared to contain 2.4 g/l free $H_2SO_4$, 16.2 g/l $SiO_2$ and 11.7 g/l $H_2O_2$. The $SiO_2$ ingredient was added in the form of sodium silicate ($SiO_2$=33.2% w/w; $Na_2O$=13.85% w/w) and a sufficient excess of sulfuric acid was provided to result in the indicated free $H_2SO_4$ content after neutralization of the $Na_2O$ in the sodium silicate.

Standard Hull cell steel panels (10 cm×6.8 cm×0.03 cm) were plated with zinc using a cyanide electrolyte. After thorough rinsing and drying, the samples were then immersed for 20 seconds in the conversion coating solution maintained at room temperature. The treated samples were then rinsed in water and then dried with a hot air gun.

The dried, coated test specimens, which had a bright luster, were then subjected to the accelerated salt spray corrosion test in accordance with the ASTM test B-117-64. The tests were carried out for 6 hours and 24 hours and showed only traces of any corrosion after 6 hours and medium corrosion after 24 hours on a rating scale from No=No corrosion<Tr/S=trace (scattered)<Tr=trace<Mi/S=mild (scattered)<Mi=mild<Me/S=medium (scattered)<Me=medium<H/S=heavy (scattered<H=heavy.

EXAMPLES 2–10

The additional beneficial effects of organophosphorus compound additives are demonstrated in these examples. The general procedures of Example 1 were followed except that the conversion coating solutions contained the organophosphorus additives in the amounts specified in Table 1, which also includes the result of the corrosion tests performed on the bright, coated test samples.

TABLE 1

| Ex. No. | Additive | Add. Conc. g/l | Extent of corrosion after 6 hrs. | 24 hrs. |
|---|---|---|---|---|
| 1 | None | — | Tr/S | Me/S |
| 2 | Aminotri(methylene phosphonic acid) | 0.75(1) | Tr/S | Me/S |
| 3 | Aminotri(methylene phosphonic acid) | 7.50(1) | ~No | Me |
| 4 | 1-Hydroxyethylidene 1,1-diphosphonic acid | 0.75(2) | ~No | Mi/S |
| 5 | 1-Hydroxyethylidene 1,1-diphosphonic acid | 1.50(2) | ~No | Tr |
| 6 | 1-Hydroxyethylidene 1,1-diphosphonic acid | 7.50(2) | ~No | Tr/S |
| 7 | Ethylenediamine tetra (methylene phosphonic acid) | 0.50(3) | ~No | Me/S |
| 8 | Hexamethylene diamine tetra (methylene-phosphonic acid) | 0.50(4) | ~No | Mi |
| 9 | Diethylene triamine penta (methylene-phosphonic acid) | 0.75(1) | ~No | Mi |
| 10 | Diethylene triamine penta (methylene-phosphonic acid) | 7.50(1) | ~No | Me/S |

(1)Active content about 50%
(2)Active content about 60%
(3)Active content about 90%
(4)Active content about 97%

EXAMPLES 11–18

The procedures followed in these test examples were essentially those described in Example 1 except that the $H_2O_2$ concentration of the coating bath was 23.4 g/l and 5 g/l of the various organonitrogen promoters listed in Table 2 were included in the solutions. The results of corrosion tests on the bright, coated test specimens are shown in the table.

TABLE 2

| Ex. No. | Additive | Extent of corrosion after 6 hrs. | 24 hrs. |
|---|---|---|---|
| 11 | None | Tr/S | Me/S |
| 12 | Thioacetamide | ~No | Tr/S |
| 13 | Urea | ~No | Mi/S |
| 14 | 1,1,3,3-Tetramethyl urea | Tr/S | Tr/S |
| 15 | Ethylenethiourea | ~No | Mi |
| 16 | N,N'-Di-n-butylthiourea | ~No | Tr |
| 17 | N,N'-Di-t-butylthiourea | ~No | Tr |
| 18 | N,N'-Dimethylthiourea | ~No | Mi |

EXAMPLES 19–22

The procedures of Example 1 were followed except that the various promoters shown in Table 3 were added to the coating bath. The results of the testing on the bright, coated samples are shown in the table.

TABLE 3

| Ex. No. | Additive | Add. Conc. g/l | Extent of corrosion after 6 hrs. | 24 hrs. |
|---|---|---|---|---|
| 19 | None | — | Tr/S | Me/S |
| 20 | Thiourea | 5 | ~No | Mi |
| 21 | 1-Hydroxyethylidene-1,1-diphosphonic acid | 1.5(1) | No | Tr |
| 22 | Thiourea + 1-Hydroxyethylidene-1,1,-diphosphonic acid | 5 + 1.5(1) | No | Tr/S |

(1)Active content about 60%

EXAMPLE 23

Zinc plated test specimens were first dipped for 20 seconds in a coating solution of the composition and temperature of Example 1 and then immediately into a second solution containing 5 g/l of thiourea in water for another 20 second period. The samples were then rinsed, dried and tested according to the procedures outlined in Example 1. The resulting coating was found to give a slightly better corrosion protection than one obtained in a one-step process involving the same compounds in the same concentrations.

What is claimed is:

1. A conversion coating solution which comprises an aqueous solution of from about 0.2 g/l to about 45 g/l of free $H_2SO_4$, from about 1.5 g/l to about 58 g/l of $H_2O_2$, and from about 3 g/l to about 33 g/l of $SiO_2$.

2. The solution of claim 1, wherein the free $H_2SO_4$ concentration is between about 1.8 g/l and about 18 g/l.

3. The solution of claim 1, wherein the $H_2O_2$ concentration is between about 7 g/l and about 29 g/l.

4. The solution of claim 1, wherein the $SiO_2$ concentration is between about 8 g/l and about 18 g/l.

5. The solution of claim 1, in which the $SiO_2$ is provided in the form of sodium silicate or potassium silicate.

6. The solution of claim 5, wherein the molecular ratio of $SiO_2$ to either $Na_2O$ or $K_2O$ in the sodium silicate or potassium silicate is maintained between about 1 and about 4.

7. The solution of claim 6, wherein said molecular ratio is at least about 2.2.

8. The solution of claim 1, containing from about 0.15 g/l to about 10 g/l of a promoter additive or mixtures of promoter additives selected from organophosphorus compounds having the general formula:

$$[X(R_1)_m]_n \cdot [R_2]_p \cdot [X(R_1)_m]_q,$$

wherein X is a group of the formula

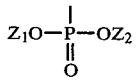

in which $Z_1$ and $Z_2$ independent from each other are hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

(c)

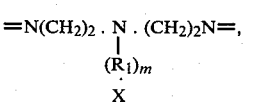

m=1, and (d) a $C_1$–$C_4$ alkylene or a $C_1$–$C_4$ hydroxy-substituted alkylene m=0 or 1.

9. The solution of claim 8, containing from about 0.5 g/l to about 2 g/l of said organophosphorus compound.

10. The solution of claim 1 containing from about 0.5 g/l to about 50 g/l of at least one organonitrogen promoter additive slected from the group consisting of thioacetamide, urea, thiourea, N,N'-alkyl substituted ureas and thioureas, cyclic N,N'-alkylene substituted ureas and thioureas, wherein said alkyl and alkylene groups each contain from 1 to 4 carbon atoms.

11. The solution of claim 10 containing from about 1 g/l to about 10 g/l of said organonitrogen promoter additive.

12. The solution of claim 9 containing from about 0.5 g/l to about 50 g/l of at least one organonitrogen promoter additive selected from the group consisting of thioacetamide, urea, thiourea, N,N'-alkyl substituted ureas and thioureas, cyclic N,N'-alkylene substituted ureas and thioureas, wherein said alkyl and alkylene groups each contain from 1 to 4 carbon atoms.

13. The solution of claim 8, wherein the organophosphorus compound is an aminotri(alkylene phosphonic acid).

14. The solution of claim 8, wherein the organophosphorus compound is a hydroxy alkylene diphosphonic acid.

15. The solution of claim 8, wherein the organophosphorus compound is a polymethylene diaminetetra(alkylene phosphonic acid).

16. The solution of claim 8, wherein the organophosphorus compound is a diethylene triaminepenta(alkylene phosphonic acid).

17. The solution of claim 10, wherein the organonitrogen promoter additive is thioacetamide.

18. The solution of claim 10, wherein the organonitrogen promoter additive is selected from urea and thiourea.

19. The solution of claim 10, wherein the organonitrogen promoter additive is selected from N,N'-alkyl substituted ureas and thioureas.

20. The solution of claim 10, wherein the organonitrogen promoter additive is selected from cyclic N,N'-alkylene substituted ureas and thioureas.

21. The solution of claim 12, wherein the organonitrogen promoter additive is thiourea.

22. The solution of claim 12, wherein the organophosphorus compound is 1-hydroxyethylidene-1,1-diphosphonic acid.

23. The solution of claim 22, wherein the organonitrogen promoter additive is thiourea.

24. In a process for the formation of corrosion resistant conversion coating onto metallic surfaces selected from zinc, cadmium, silver, copper, aluminum, magnesium and zinc alloys, wherein the metallic surfaces are immersed in a conversion coating solution, and subsequently rinsed and dried, the improvement which comprises:

immersing the metallic surfaces into the conversion coating solution of claim 1.

25. The process of claim 24, in which the metallic surfaces are immersed into the conversion coating solution of claim 8.

26. The process of claim 24, in which the metallic surfaces are immersed into the conversion coating solution of claim 10.

27. The process of claim 24, in which the metallic surfaces are immersed into the conversion coating solution of claim 12.

28. The process of claim 24, in which prior to rinse, the metallic surfaces are immersed for a period of about 5 to about 300 seconds into a second aqueous treatment solution containing from about 0.5 g/l to about 50 g/l of at least one organonitrogen compound selected from the group consisting of thioacetamide, urea, thiourea, N,N'-alkyl substituted ureas and thioureas, cyclic N,N'-alkyl substituted ureas and thioureas, cyclic N,N'-alkylene substituted ureas and thioureas, wherein said alkyl and alkylene groups each contain from 1 to 4 carbon atoms.

29. The process of claim 25, in which prior to rinse, the metallic surfaces are immersed for a period of about 5 to about 300 seconds into a second aqueous treatment solution containing from about 0.5 g/l to about 50 g/l of at least one organonitrogen compound selected from the group consisting of thioacetamide, urea, thiourea, N,N'-alkyl substituted ureas and thioureas, cyclic N,N'-alkyl substituted ureas and thioureas, cyclic N,N'-alkylene substituted ureas and thioureas, wherein said alkyl and alkylene groups each contain from 1 to 4 carbon atoms.

30. The process of claim 28 wherein the second aqueous treatment solution also contains from about 0.15 g/l to about 10 g/l of at least one organophosphorus compound having the general formula:

$$[X(R_1)_m]_n \cdot [R_2]_p \cdot [X(R_1)_m]_q,$$

wherein

X is a group of the formula

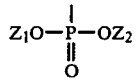

in which $Z_1$ and $Z_2$ independent from each other are hydrogen, sodium or potassium;

m is either 0 or 1;

p is either 0 or 1;

n+q is either (a) 1 when p=0, or (b) equal to the number of available bonds provided by $R_2$ when p=1;

$R_1$ is a (a) $C_1$–$C_4$ alkyl or a $C_1$–$C_4$ hydroxy-substituted alkyl and p=0; and (b) $C_1$–$C_4$ alkylene or a $C_1$–$C_4$ hydroxy-substituted alkylene and p=1;

$R_2$ is selected from (a) N≡, m=1

(b) $=N(CH_2)_rN=$, m=1 and r is an integer from 2 to 6

(c)

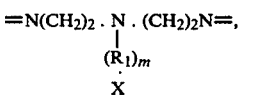

m=1, and (d) a $C_1$–$C_4$ alkylene or a $C_1$–$C_4$ hydroxy-substituted alkylene, m=0 or 1.

31. A metallic surface coated by the process of claim 24.

32. A metallic surface coated by the process of claim 25.

33. A metallic surface coated by the process of claim 26.

34. A metallic surface coated by the process of claim 27.

35. A metallic surface coated by the process of claim 28.

36. A metallic surface coated by the process of claim 29.

37. A metallic surface coated by the process of claim 30.

38. The metallic surface of claim 31, wherein the metal is zinc plate.

* * * * *